US006533024B2

(12) United States Patent
Streubel et al.

(10) Patent No.: US 6,533,024 B2
(45) Date of Patent: Mar. 18, 2003

(54) METHOD FOR CHANGE OF SECTION OF A BILLET BELOW A CASTING DIE OF A CONTINUOUS CASTING PLANT

(75) Inventors: Hans Streubel, Erkrath (DE); Günter Kneppe, Hilchenbach (DE); Olaf Norman Jepsen, Siegen (DE); Holger Beyer-Steinhauer, Mettmann (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/733,004

(22) Filed: Dec. 8, 2000

(65) Prior Publication Data

US 2001/0017197 A1 Aug. 30, 2001

(30) Foreign Application Priority Data

Dec. 15, 1999 (DE) ..... 199 60 688
Aug. 5, 2000 (DE) ..... 100 38 291

(51) Int. Cl.[7] ..... B22D 11/128
(52) U.S. Cl. ..... 164/454; 164/484
(58) Field of Search ..... 164/454, 484, 164/441, 442, 413, 476, 417

(56) References Cited

U.S. PATENT DOCUMENTS 5,511,606 A * 4/1996 Streubel ..... 164/476
6,209,619 B1 * 4/2001 Morwald et al. ..... 164/454

FOREIGN PATENT DOCUMENTS

| | | |
|---|---|---|
| DE | 1583620 | 8/1970 |
| DE | 4436328 | 4/1995 |
| DE | 4338805 | 5/1995 |
| DE | 196 39 297 A1 | 3/1998 |
| EP | 0286862 | 10/1988 |
| EP | 0535368 | 4/1993 |
| EP | 0450391 | 5/1995 |
| EP | 0743116 | 11/1996 |

* cited by examiner

*Primary Examiner*—Kuang Y. Lin
(74) *Attorney, Agent, or Firm*—Friedrich Kueffner

(57) ABSTRACT

In a method for changing a billet section of a continuous billet casting device from an initial section to a final section, the opposed billet sides interact with oppositely positioned roll supports of a billet guide arranged below a continuous casting die. The roll supports have segments with rolls, and each segment is individually adjustable with respect to its angular position relative to the billet. A controlled sequence of adjusting steps of the segments successively arranged in a direction of continuous casting is carried out, wherein, for reducing the section of the billet, the segments are advanced successively toward the billet in the continuous casting direction and, and for increasing the section of the billet, the segments are moved successively away from the billet in the continuous casting direction.

18 Claims, 7 Drawing Sheets lü = transition length

METHOD FOR CHANGE OF SECTION OF A BILLET BELOW A CASTING DIE OF A CONTINUOUS CASTING PLANT

BACKGROUND OF THE INVENTION

1. Field of the Invention

The invention relates to a method for change of section of a billet of a continuous casting device operating by continuous casting, wherein opposite sides of the billet below the casting die interact with oppositely positioned roll supports of a billet guide which are divided into a sequence of segments that support rolls. Each segment can be separately adjusted with regard to its angle relative to the billet. In an initial position the entire strand guide to be adjusted for section change is adjusted to a production format thickness.

2. Description of the Related Art

In a method disclosed in EP 0 286 862 A1 the billet, which is cast in a continuous casting die and has a thickness of 40 to 50 mm, is compressed after exiting the casting die by a pair of rolls such that the inner walls of the billet shell formed in the casting die are welded together.

During continuous casting in a continuous casting die of a certain length the thickness of the formed billet shell depends substantially on the casting speed. For ensuring a constant roll gap of the roll pair, the rolling force must be adjusted to the current thickness of the billet shell. When the casting speed is too minimal, the applied rolling force is not sufficient so that the nominal thickness of the produced billet is surpassed. When the casting speed is too high, welding of the billet shell can be achieved only by falling below the nominal thickness of the produced casting billet.

In order to prevent an undesired thickness deviation of the produced cast billet and to achieve a good inner microstructure, in a method disclosed in EP 0 535 368 B1 the thickness of the cast billet is reduced by roll forming and the billet is subsequently rolled, wherein the cast billet is comprised of a solidified billet shell and a liquid core. In this connection, the cast billet is cast with a thickness of 40 to 80 mm, and, subsequently, the billet is roll-formed by maximally three passes to a thickness of 15 to 40 mm and to 2 to 15 mm residual liquid core. Subsequently, the billet is divided into conventional billet lengths, is heat-treated in a compensation furnace, and, subsequently, for example, hot-rolled by reversing rolling. In this method for thickness reduction of the cast billet below the casting die, a transition piece with a reduced thickness results which cannot be rolled but must be separated from the billet and then cut as scrap metal. The reduced thickness moreover results in the transition piece being relatively cold so that the scissors during cutting are greatly loaded.

On the other hand, the changes of section in the continuous casting device during the casting operation are a necessary requirement for production optimization. Accordingly, the patent literature discloses various methods.

The patent DE 43 38 815.2 describes a method and a device for operating a continuous casting device, in particular, during cast-on of the continuous casting device for producing thin billets for hot roll treatment, with at least one reduction roll pair downstream of the continuous casting die followed by adjustable billet guiding elements. The reduction roll pair is adjusted, after a predetermined pass length of the cast billets, to a smaller gap width which results in squeezing off the sump. The cast billet is deformed to a cast-on format having a thickness below the thickness of the desired final format. The billet guiding elements or the reduction roll pair is then adjusted to the thickness of the final format as soon as the less thick cast-on format has reached completely its adjusting range. The reduction roll pair is pressure-controlled and after adjustment of the billet guide is positioned to match the final format.

EP 0 743 116 A1 discloses a vertical casting line for cast billets, comprising a casting die as well as a component group with foot rolls adjoining the outlet of the casting die, and, moreover, a plurality of guide units, correlated roll segments as well as a driver arrangement in connection with a horizontal segment of the casting line. The guide elements comprise at least the entire vertical segment of the casting line wherein at least some of the rolls of the guide units cooperate with adjusting devices which are governed by a process data unit in order to ensure a controllable soft reduction at least within the second part of the vertical segment.

The published document DE 196 39 297 A1 describes a method and a device for high-speed continuous casting devices with a billet thickness reduction during solidification. In the method and the corresponding device for continuous casting of billets, the billet cross-section is thickness-reduced linearly during solidification across a minimum length of the billet guide directly underneath the casting die. With the subsequent further billet cross-section reduction across the residual billet guide, the so-called soft reduction, up to maximally directly before the final solidification or the sump tip, a critical deformation of the billet, taking into account the casting speed as well as the steel quality, can be eliminated.

The patent document EP 0 450 391 B1 discloses a device for supporting a cast metal billet, in particular, for soft reduction, in a steel strip casting device, wherein below the billet casting die at both sides of the cast billet mirror-symmetrically positioned roll supports are provided whose rolls interact with the cast billet. Each roll support is arranged on a fixed frame and divided into several roll-supporting segments which are connected to adjusting devices. The segments are coupled to one another in a jointed fashion such that each segment can be individually adjusted at any desired angle relative to the cast billet and that the upper adjusting device provides for a general adjustment of the roll support. This can be a mechanical, hydraulic, or mechanical-hydraulic adjusting device.

SUMMARY OF THE INVENTION

It is an object of the present invention to provide a method as well as a device for performing the method suitable for format thickness changes of the cast billet of a continuous casting device operating in continuous casting operation, wherein the casting speed for the transition process for a format thickness (section) change must not be reduced, i.e., constant production and casting conditions should be maintained. The transition length of the billet during the format thickness change should be comparatively shortened for avoiding production losses. In all transition situations of the format thickness change for reducing the break-out risk, an optimal billet support should be ensured. Cold reduced thickness portions, which highly mechanically load the cutting shears, are to be avoided.

In accordance with the present invention, this is achieved in that the change of section (change of the billet format thickness) is carried out in a controlled sequence of adjusting steps of the segments n=1 to n=i, wherein for a section reduction a sequential adjustment in the casting direction of the successively arranged segments (n=1 to i) toward the billet and for a section increase a sequential adjustment in the casting direction of the successively arranged segments (n=1 to i) away from the billet is carried out and that a transition length of the thickness change (section change) is produced which is at least 50%, preferably 80 to 90%, of the billet length.

With the measures according to the invention for performing a section change of the cast billet, it is achieved that the casting speed, for example, for a change from a thicker format to a thinner format or from a thinner format to a thicker format, must not be changed and the casting conditions can be maintained substantially constant. Crop losses, which mean production losses, are avoided. Cold, reduced thicknesses at the leading end or the trailing end of the billet, which cause an unnecessary mechanical loading of the cutting shears, are prevented. The thickness or section changes can be carried out continuously within a wide adjusting range as a function of the respective production program and thus result in a high flexibility of the device. A special advantage is the adaptation of the cast-on thickness in the rolling mill to the required final rolling thickness.

In one embodiment of the invention it is suggested that the cast billet is adjusted to a constant thickness at the leading end of the billet over a length of approximately 1 to 4 meters, and, moreover, it is suggested that the trailing end of the cast billet is adjusted to a constant thickness over a length of approximately 0.5 m to 2 m.

As a further development of the invention, it is suggested that the length of the transition section of the thickness or section change follows in the longitudinal direction a defined wedge shape with a defined billet profile. This means that between the billet beginning and the billet end, each having a constant thickness, a transition format having a wedge shape is arranged so that the resulting billet wedge can be rolled while maintaining an acceptable billet profile. The transition length depends on the amount of thickness reduction and the adjusting parameters. With this method, even in the case of great thickness changes of the billet of approximately 25 mm, the thickness gradient is sufficiently small so that no thickness tolerance problems occur during rolling.

In an essential further development of the principle of the invention, for a billet guide which is comprised of, for example, four segments n=1 to n=4, the defined wedge of the billet is produced with a defined billet profile with the following adjusting steps.

Starting at a certain length, the segment 1 at the exit side and the segment 2 at the entry side are advanced toward or moved away from the billet. Subsequently, with time delay or with a travel delay, i.e., delay for traveling the length of the segment 2, the segment 2 at the exit side and the segment 3 at the entry side are advanced toward or moved away from the billet. Subsequently, again delayed by the travel length of the segment 3, the segment 3 at the exit side and the segment 4 at the entry side are advanced toward or moved away from the billet. Subsequently, the exit side of segment 4, again delayed by the travel length of the segment 4, is advanced toward or moved away from the billet. Advantageously, all segments are moved until they have been adjusted to the final (target) thickness. The adjusting steps are performed simultaneously or substantially simultaneously. The adjusting speed is comparatively minimal and is, for example, less than 2.5 mm/min. With such an operation, a billet profile is produced which has no unacceptable thickness differences center/edge for rolling.

One embodiment of the method proposes that for a section change increase (thickness increase) at constant casting speed, wherein the sump tip of the billet, for example, is within the segment n=3, in a first adjusting phase the first segment n=1 at the exit side is moved away from the billet by means of the joint connection together with the segment n=2 at the entry side by set-point control and, after reaching the target position, i.e., the segment position for the target or final format, in a second adjusting phase the exit side of segment n=2 is moved away from the billet with the entry side of segment n=3 and that successively, in a sequence of identical steps, the adjustment of the segments n=3, 4 to i to the target position is carried out.

According to a further embodiment of the method according to the invention, the advancement of the segments toward the billet is carried out at a constant speed by means of dynamic control, wherein a force threshold to be determined is not to be surpassed.

Furthermore, it is suggested according to the invention that the advancing speed of the segments is calculated with consideration of the permissible billet elongation limits and the actual casting speed in connection with the actual format adjustment or based on the resulting volume stream of the billet.

Advantageously, the adjusting speed is calculated based on the actual casting speed, the segment length, and the required adjusting travel according to the following formula:

$$V=Ds/Ls*Vcast$$

wherein Ds is the format thickness change (change of section), Ls is the segment length, and Vcast is the current casting speed.

Further embodiments of the method propose that the adjusting process is monitored, for example, by means of actual cylinder pressures of hydraulic adjusting devices and, upon surpassing a threshold, position control is switched to force control and that, after reaching the target position, the system is switched back to position control.

Details, features, and advantages of the invention result from the following discussion of an embodiment schematically illustrated in the drawings.

DESCRIPTION OF THE PREFERRED EMBODIMENTS

Figure 1:
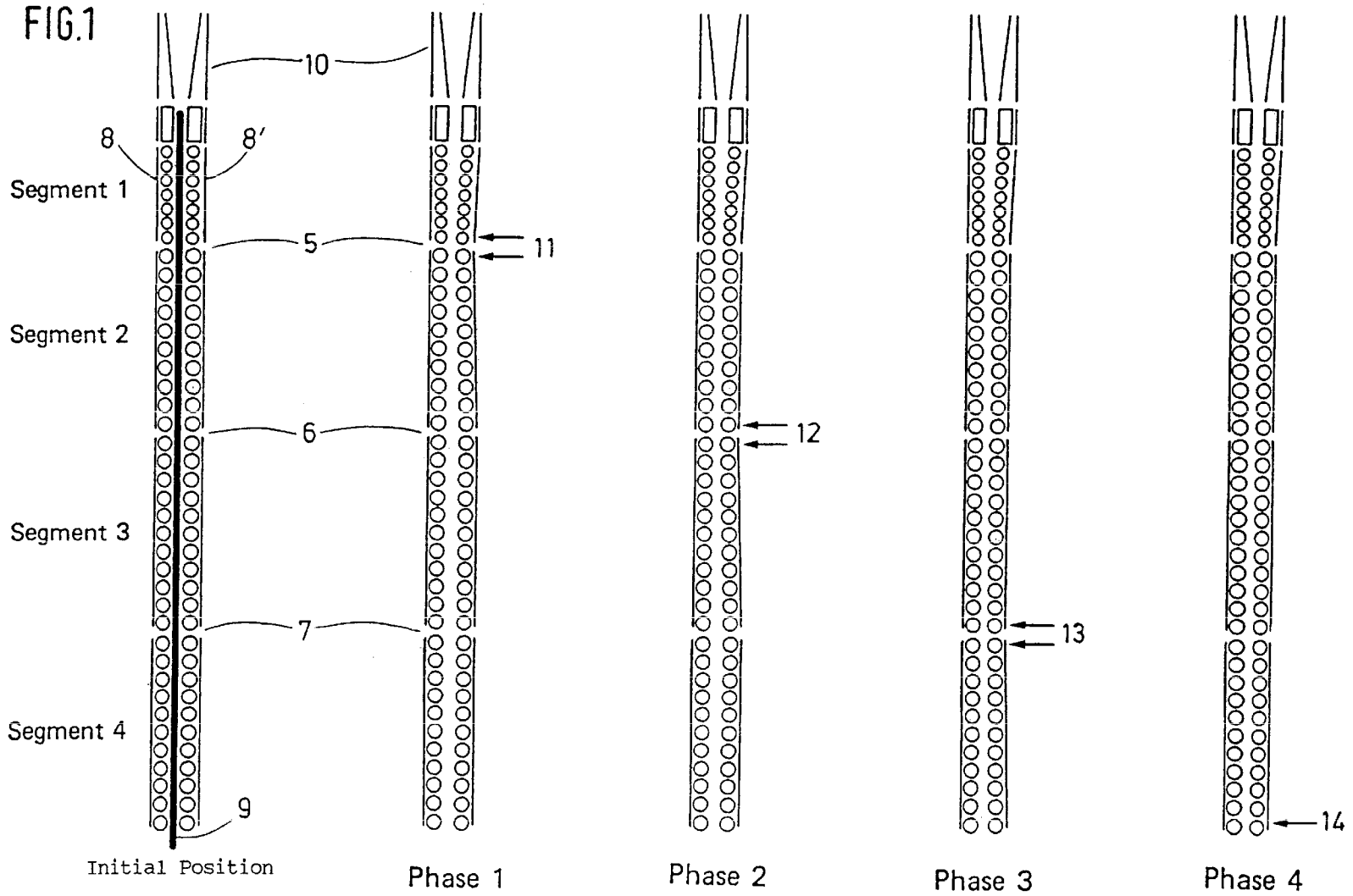
FIG. 1 shows the operating sequence of the method according to the invention, divided into successively occurring adjusting steps or phases, for illustrating a section reduction.
Figure 7:
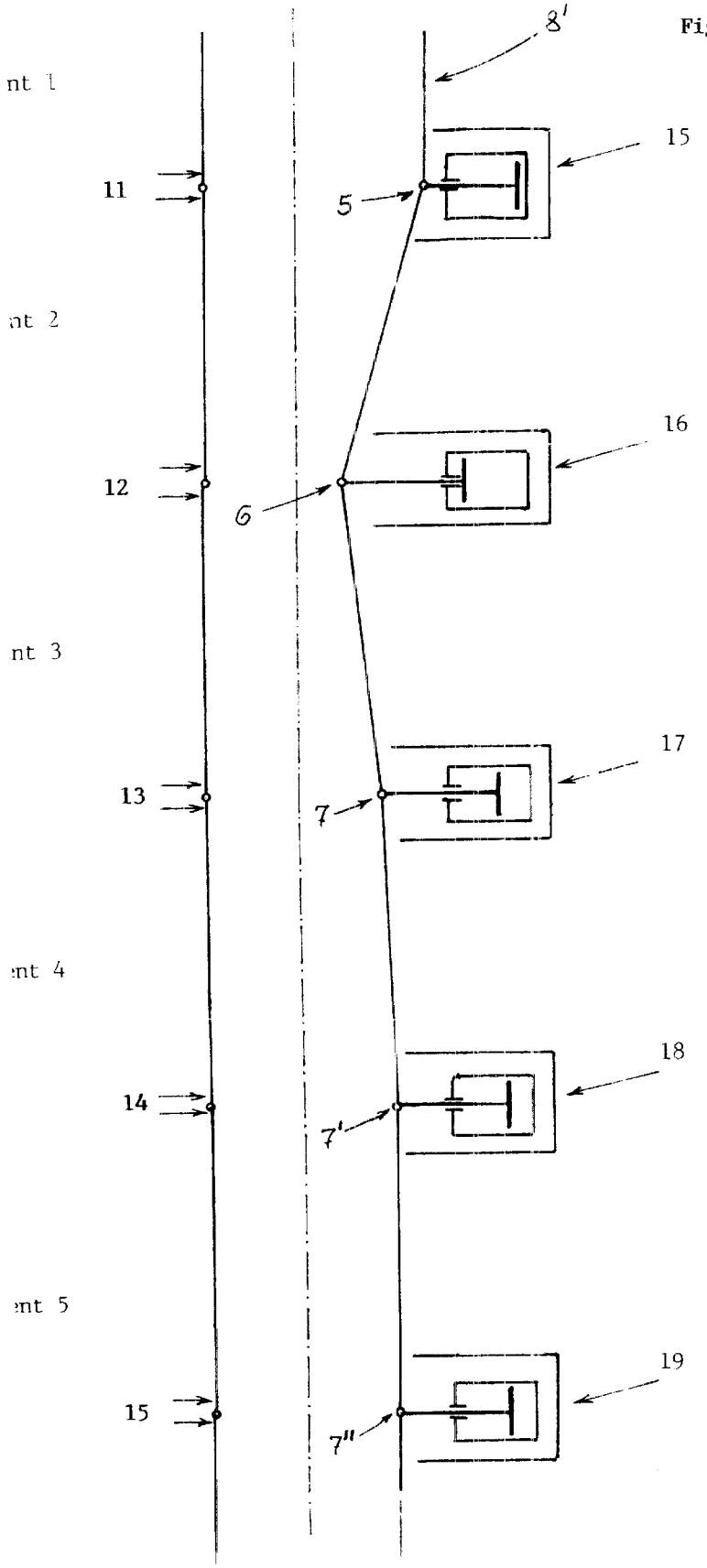
FIG. 7 is a schematic illustration of a device for changing the section of a billet with hydraulic adjusting devices for adjusting the segments of the device.

FIG. 1 shows the operation of the method for a format thickness reduction (section reduction) of a cast billet 9 of a continuous casting device in continuous casting operation. The billet 9 interacts below the casting die 10 with both opposed sides with mirror-symmetrically oppositely arranged roll supports 8, 8' which are divided into a sequence of roll-carrying segments 1 to 4 connected to one another by joints or joint connections 5 to 7. Each segment 1 to 4 is individually adjustable with regard to its angle relative to the cast billet 9. As shown in FIG. 7, the segments are adjustable by means of hydraulic adjusting devices 15–19. In an initial position the entire billet guide to be changed is adjusted to a uniform production format thickness, as is illustrated in the shown initial position. The format thickness change (section change) is performed in a controlled sequence of adjusting steps of the segments 1 to 4.

The section reduction is carried out by means of advancing the sequentially arranged segments 1 to 4 toward the billet, as is illustrated by the phases 1 to 4. Beginning with the exit side of segment 1, the joint connection 5 with the entry side of segment 2 is advanced by set-point control. After reaching the target position, i.e., the segment position for the target format, in a second adjusting phase the exit side of segment 2 together with the entry side of segment 3 is advanced toward the billet 9, and in successive identical steps the adjustment of the segments 3 and 4 is then carried out according to the illustrated phases 3 and 4. For this purpose, a force means 11 engages the joint connection 5 in the direction of narrowing the cast billet 9, followed in the phase 2 by activation of the adjusting device 12 in the direction of narrowing the billet cross-section and, moreover, successively in phases 3 and 4, the adjusting devices 13 and 14 are advanced until a continuous format thickness reduced in its entirety is reached in accordance with the final state in phase 4.

Based on the illustration of the operation for a section reduction, the initial position of the billet guide is realized before the phase 1, and in this initial position the entire billet guide is adjusted during casting operation to a production width X. The casting speed is constant, the sump tip is positioned in the segment 3.

For starting the thickness reduction according to phase 1, as mentioned before, the exit side of segment 1 and the entry side of segment 2 are guided set-point controlled with a constant speed by means of dynamic position control. During this step, a pre-determined force threshold is not surpassed. The advancing speed is calculated with consideration of the permissible billet elongation limits and the actual casting speed in connection with the actual format adjustment or according to the volume stream of the billet resulting therefrom.

The adjusting speed to be maintained is calculated based on the actual casting speed, the segment length, and the required adjusting travel according to the formula $$V=Ds/Ls*Vcast$$

wherein Ds is the format thickness change (change of section), Ls is the segment length, and Vcast is the current casting speed.

By means of effective force monitoring, the force being calculatable, for example, via the actual cylinder pressures of a hydraulic adjusting device, the adjusting process is monitored. Should the force surpass a calculated limit, the system is switched from position control to force control. After reaching the target position, the system is switched back to position control.

With the described operation it is achieved that, for a reduced material thickness of the continuously decreasing wedge shape, the roll skirt provides a sufficient supporting action for the billet 9 and that the exit side can be adjusted according to the material thickness.

The sump present in the segment 1, 2 and, optionally, 3 is not interrupted by the process. The billet support is provided in all phases by switching from position control to force control.

Figure 2:
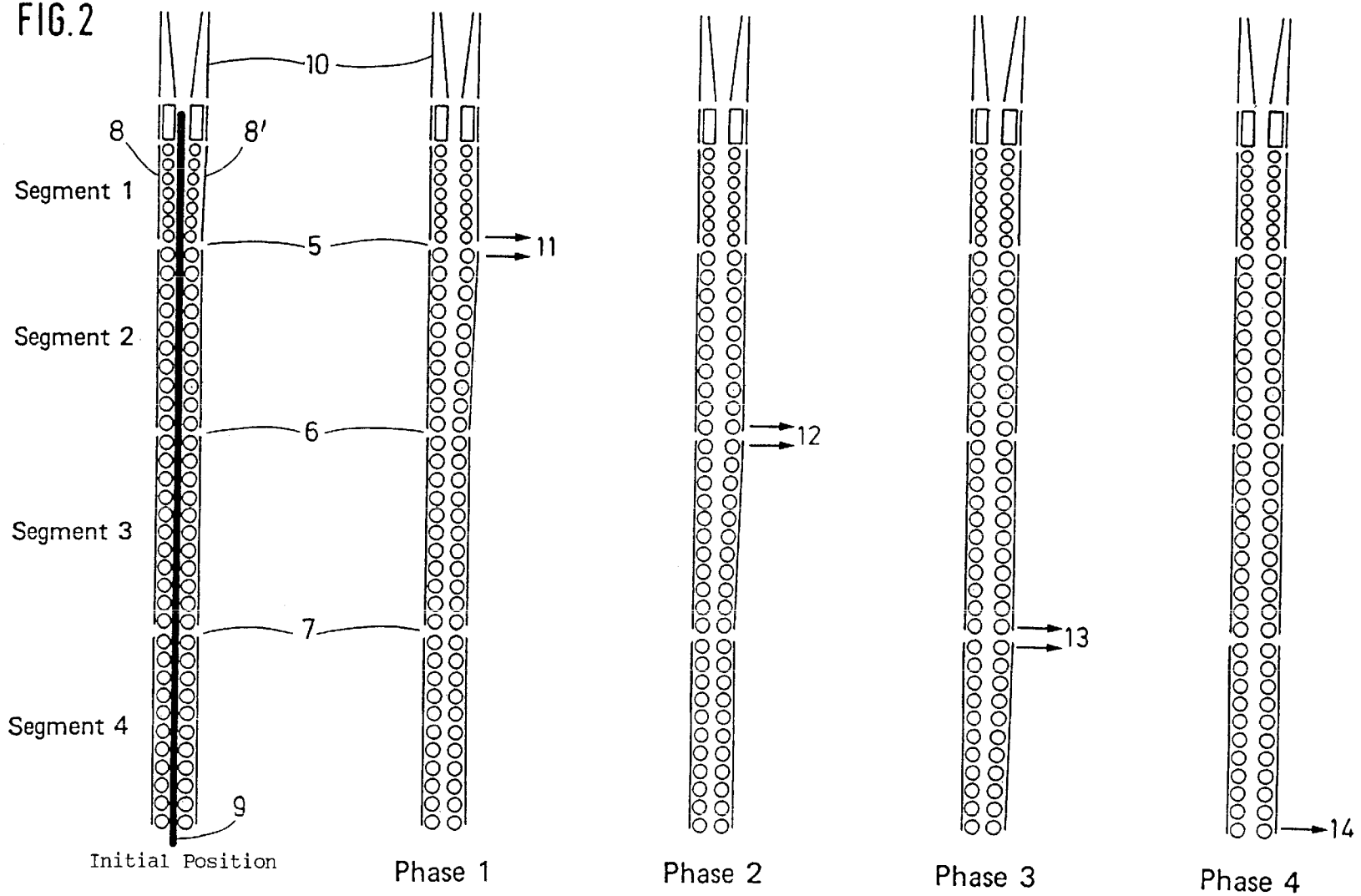
FIG. 2 shows the operating sequence of the method according to the invention of successively occurring adjusting steps for illustrating a section increase.

In the following, the function of the format thickness increase is described according to the representation of FIG. 2.

First, in the initial position of phase 1, the entire billet guide is adjusted during the casting operation to a production thickness X. The casting speed is constant, the sump tip is positioned in the segment 3, the thickness increase is started with the phase 1.

As soon as the target format of the exit side of segment 1 and the entry side of segment 2 has been reached at the end of the phase 1, the exit side of segment 2 is widened, i.e., moved away from the billet (phase 2).

The adjusting speed is calculated based on the actual casting speed, the segment length, and the required adjusting travel, as in the case of section reduction.

An effective force monitoring, the force being calculated via the actual cylinder pressures of hydraulic adjusting devices, controls the adjusting process.

Should the force surpass a calculated limit, the system is switched from position control to force control. After reaching the target position, the system is switched back to position control.

With the described operation it is achieved that also for increased material thickness for a continuously increasing wedge shape, the roll skirt provides a sufficient supporting action for the billet 9 and that the exit side can be adjusted according to the material thickness.

Subsequently, the entry side of segment 3 is widened (moved away from the billet) simultaneously with the exit side of segment 2 at the same adjusting speed, in accordance with phase 2. The monitoring function is carried out as described in the case of the exit side of segment 2.

As soon as the target format of the entry side of segment 3 has been reached, the exit side of segment 3 and the entry side of segment 4 is widened (phase 3). The calculation of the casting speed and the monitoring action is carried out as explained above.

As soon as the target format of the entry side of segment 4 has been reached, the exit side of segment 4 is widened (phase 4). The calculation of monitoring action is carried out as described above.

Finally, it is provided that, as a result of the joint connection of the exit side of one segment with the entry side of the successively arranged segment, the adjusting speeds of the jointed segments are inevitably synchronous.

As a result of the described operation of the method for section (thickness) change for continuous casting devices it is achieved that:

- the casting speeds are not reduced for the transition so that, in comparison to the prior art, an increase of the production output is realized and constant production and casting conditions are provided;
- the length of the transition section of the billet to be produced is shortened so that production losses are reduced;
- the thickness changes can be carried out in continuously selectable sizes within a wide adjusting range as a function of the production program and result thus in high flexibility of the device;
- for a reduced material thickness with continuously decreasing wedge shape, the roll skirt provides a sufficient billet support, wherein the exit side is adjusted according to the material thickness, while for a format thickness increase it is achieved that, for increased material thickness as a result of the continuously increasing wedge shape, the roll skirt provides a sufficient billet support and the exit side is adjusted according to the material thickness.

In a device for section change of the billet of a continuous casting device, wherein the billet interacts below a casting die with both opposed sides with oppositely positioned roll supports which are divided into a sequence of roll-carrying segments which are coupled to one another by joint connections, wherein each segment is individually adjustable at an angle relative to the billet, the adjusting device is advantageously provided with means for position control or force control. Expediently, the segments in the area of the joint connections between the exit and entry sides are in interactive connection with controlled as well as direction-reversing hydraulic cylinders, wherein the segment n=1 interacts only with its exit side with such a hydraulic cylinder.

Figure 3:
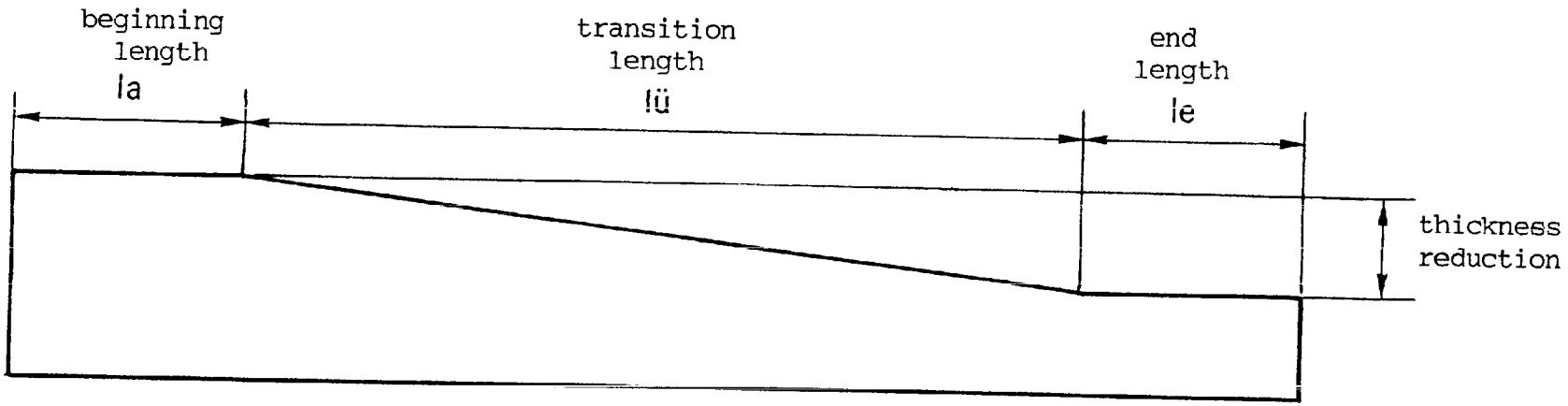
FIG. 3 shows the thickness (section) reduction of a billet according to the invention below a casting die with a wedge-shaped transition section.

FIG. 3 show schematically the result of the section change by means of the adjustment according to the invention of the segments of the billet guide. Clearly shown is the beginning length la which has not yet been subjected to a thickness reduction. Adjoining the beginning length la is the transition section with length lü which results in that the individual segments of the billet guide are moved toward the billet in the manner according to the invention as described above. The end length le with the desired final thickness adjoins the transition length lü. The difference of thicknesses of the beginning length and of the end length provides the thickness reduction.

Figure 4:
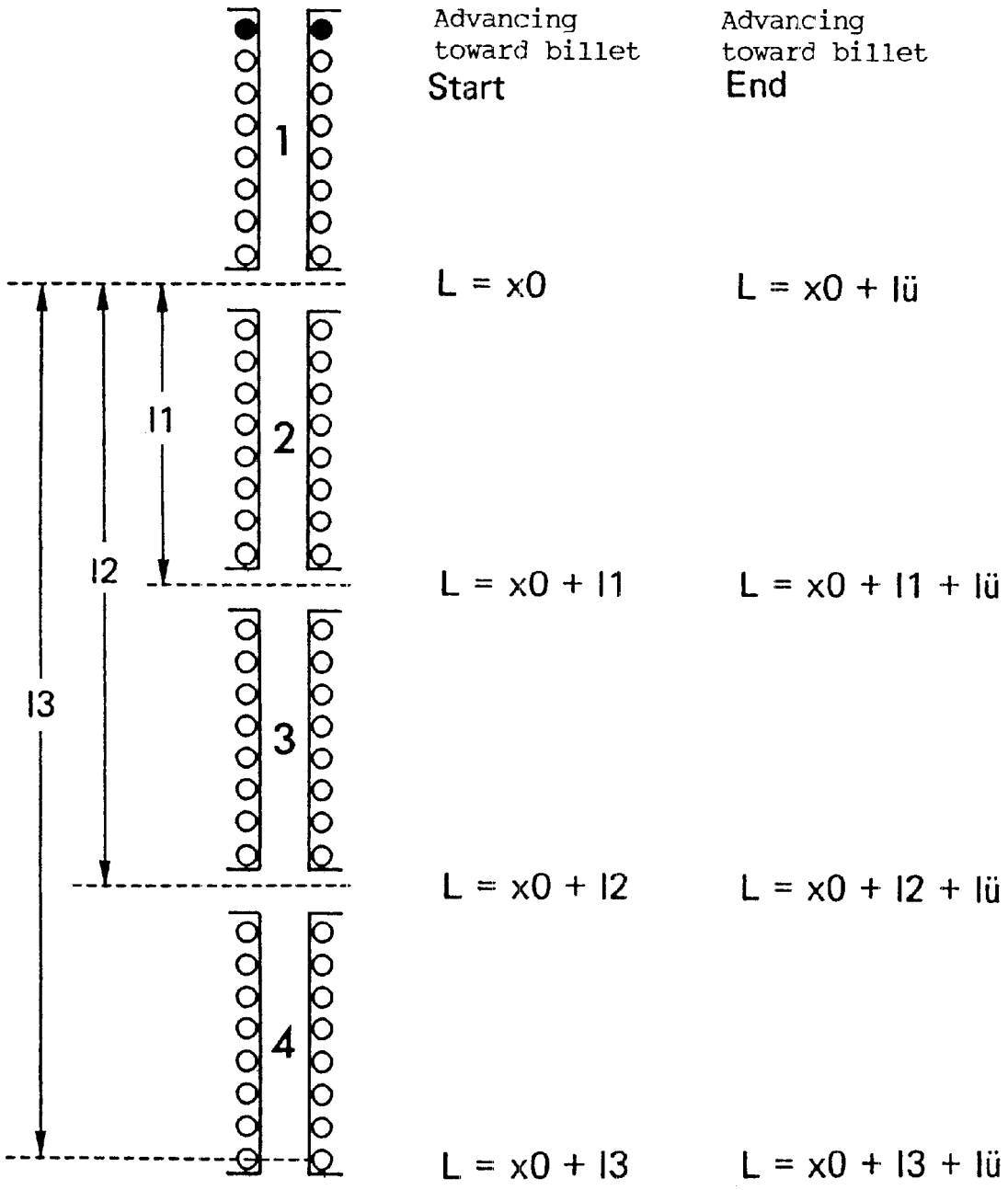
FIG. 4 is an adjusting schematic of the segments for thickness (section) reduction of the billet.

FIG. 4 schematically shows the corresponding method, for example, for four segments of the billet guide. The individual segments n=1 to n=4 have a certain defined length 11, 12, 13 correlated therewith. The wedge-shaped transition length is identified by lü. In order to adjust the transition length lü with the defined billet wedge (FIG. 1), the segments n=1 to n=4 are adjusted by means of the adjusting cylinders.

Figure 5:
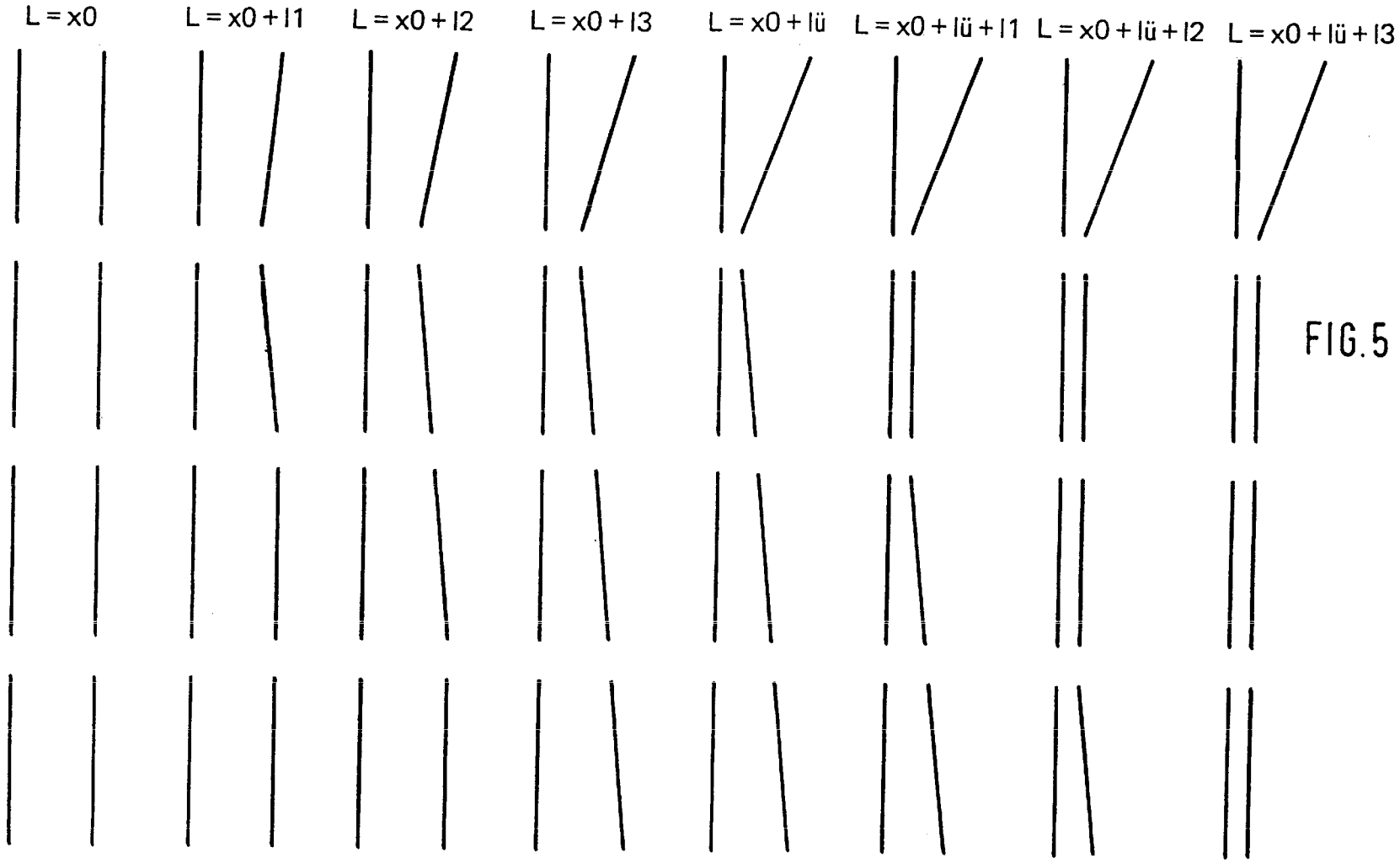
FIG. 5 is a schematic operational sequence for the adjustment of the segments.
Figure 6:
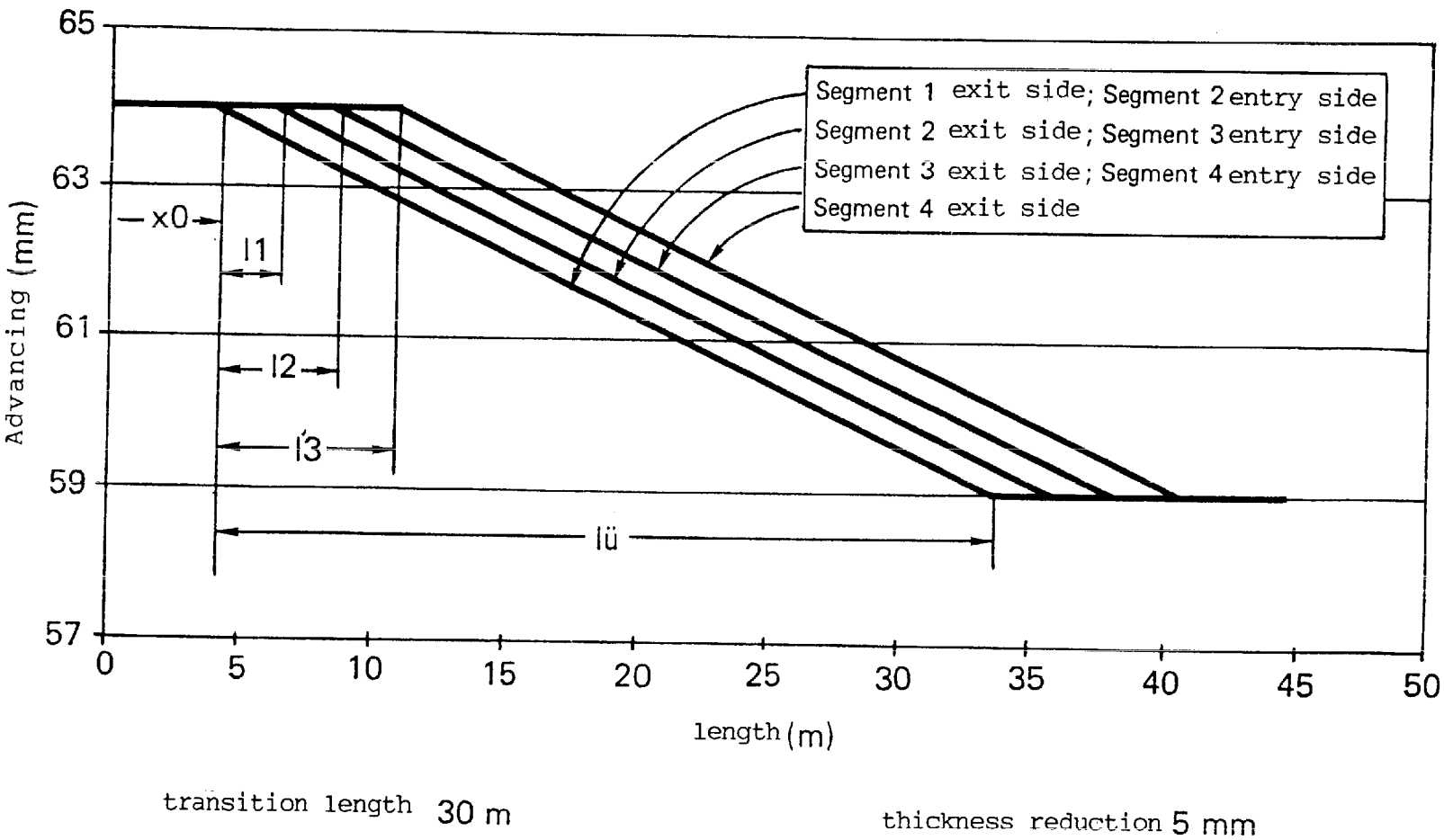
FIG. 6 is a schematic course of the segment adjustment during thickness reduction.

The 'schematic step sequence of the adjusted individual segments results from FIG. 5. Starting at a length 1=0, the exit side of segment 1 and the entry side of segment 2 are advanced toward the billet. With time delay or travel delay by the length 11 of the segment 2, subsequently the segment 2 at the exit side and the segment 3 at the entry side are moved toward the billet. Again with travel delay about the length 12 of the segment 3, the exit side of segment 3 and the entry side of segment 4 are then moved. In the final step, again with travel delay by the length 13 of segment 4, the exit side of segment 4 is narrowed. At the left side of FIG. 5, the initial position of all four segments is illustrated. At the right side of FIG. 5, the end of the advancing movement of the individual segments relative to the billet is shown, wherein the segments n=2 to n=4 have reached their adjusted position provided for thickness reduction. The segments are all advanced toward the billet in a length-staggered way as a function of a travel follower system by the same travel $\Delta D$ within the predetermined transition length. The time of the beginning of adjustment of each segment depends on the spacing of the entry and exit rolls of the segments relative to the last roll of the first segment.

FIG. 4 shows a schematic course of the cylinder adjustment for the individual segments 1 to 4. All segments are advanced until they have reached the final thickness position (target position). The four segments are moved simultaneously during most of the operating sequence. For a transition length lü of 30 m for a thickness reduction of 15 mm and a casting speed of 5 m/min. the advancing speed of the cylinders is only approximately 2.5 mm/min. With this advancing mode a defined billet wedge with defined billet profile results without causing a significant rolling of the billet. The billet edge, as in the conventional methods, is almost exclusively formed by the segment 1.

The solidification thickness is adjusted such that the desired final rolling thickness can be rolled without limitations with the greatest entry thickness. This results in the following advantages:

1. greatest possible production output;
2. greatest possible buffer time in the continuous furnace;
3. greatest possible coil weight, in particular, for multi-billet devices.

While specific embodiments of the invention have been shown and described in detail to illustrate the inventive principles, it will be understood that the invention may be embodied otherwise without departing from such principles.

What is claimed is:

1. A method for changing the section of a billet of a continuous billet casting device from an initial section to a final section, wherein opposed sides of the billet are in interactive contact with oppositely positioned roll supports of a billet guide arranged below a continuous casting die, wherein the roll supports are comprised of segments having rolls, wherein each segment is configured to be individually adjusted with respect to an angular position relative to the billet, and wherein in an initial position of the roll supports the segments are adjusted to a uniform production section of the billet; the method comprising the steps of:

carrying out a controlled sequence of adjusting steps of the segments successively arranged in a direction of continuous casting, wherein, for reducing the section of the billet, the segments are advanced successively toward the billet in the transverse direction of continuous casting and, for increasing the section of the billet, the segments are moved successively away from the billet in the transverse direction of continuous casting; and generating a transition section providing a transition from the initial section of the billet to the final section of the billet, wherein the transition section has a length of at least 50% of a length of the billet.

2. The method according to claim 1, wherein the length of the transition section is 80% to 90% of the length of the billet.

3. The method according to claim 1, further comprising the steps of adjusting a leading end of the billet in the direction of casting over a length of approximately 1 to 4 m to a constant thickness and adjusting the trailing end of the billet in the direction of casting over a length of approximately 0.5 m to 2 m to a constant thickness.

4. The method according to claim 1, wherein the transition section has a defined wedge profile in a longitudinal direction of the billet and a defined billet profile, wherein a change of the thickness is at least approximately linear.

5. A method according to claim 4, wherein, when the billet guide has at least four segments, the billet profile for reducing the section is formed by the steps of:

at a selected length zero of the billet, moving an exit side of a first of the segments and an entry side of a second of the segments toward the billet;

subsequently, time-delayed or travel-delayed by a length of the second segment, moving an exit side of the second segment and an entry side of a third of the segments toward the billet;

subsequently, travel-delayed by a length of the third segment, moving an exit side of the third segment and an entry side of a fourth of the segments toward the billet; and subsequently, travel-delayed by a length of the fourth segment, moving an exit side of the fourth segment toward the billet, wherein all segments are moved toward the billet until a preset final thickness is adjusted.

6. The method according to claim 5, wherein the adjusting speed is <2.5 mm/min.

7. The method according to claim 5, wherein, for a constant casting speed and with the solidification point of the billet having passed the first and second segments, the exit side of the first segment and the entry side of the second segment in the casting direction are advanced in a first one of the adjusting steps toward the billet by moving the first and second segments at a joint connecting the first and second segments toward the billet controlled in accordance with a set-point, and after the first and second segments have reached a target position, an exit side of the second segment and an entry side of the third segment in the casting direction are advanced in a second one of the adjusting steps toward the billet by moving the second and third segments at a joint connecting the second and third segments toward the billet, and after the second and third segments have reached a target position, the third and further segments are advanced toward the billet sequentially in the same manner in further ones of the adjusting steps until all segments have reached a target position.

8. The method according to claim 7, wherein the segments are adjusted at a constant adjusting speed with dynamic position control without surpassing a predetermined force threshold value, the method further comprising the step of determining an adjusting speed of the segments for advancing the segments based on permissible billet elongation limits and a current casting speed in combination with a current format adjustment of the section or based on a required volume flow of the billet.

9. The method according to claim 8, wherein the adjusting speed is calculated, based on the current casting speed, the segment length, and the format thickness change, by the equation $$V=Ds/Ls*Vcast$$

wherein Ds is the format thickness change, Ls is the segment length, and Vcast is the current casting speed.

10. The method according to claim 9, wherein the adjusting steps are carried out by hydraulic adjusting devices, further comprising the step of monitoring the adjusting steps via current cylinder pressures of the hydraulic adjusting devices, wherein, when a predetermined force threshold value is surpassed, force control is applied instead of position control and wherein, when the target position has beer reached, the position control is applied again.

11. The method according to claim 10, wherein the adjusting steps are hydraulically controlled and wherein the adjusting steps begin at an exit side of the first segment in the casting direction and are successively continued at the entry side and the exit side of the successively arranged segments, and wherein the adjusting speed of two successively arranged segments is inevitably synchronous.

12. The method according to claim 4, wherein, when the billet guide has at least four segments, the billet profile for increasing the section is formed by the steps of:

at a selected length zero of the billet, moving an exit side of a first of the segments and an entry side of a second of the segments away from the billet;

subsequently, time-delayed or travel-delayed by a length of the second segment, moving an exit side of the second segment and an entry side of a third of the segments away from the billet;

subsequently, travel-delayed by a length of the third segment, moving an exit side of the third segment and an entry side of a fourth of the segments away from the billet; and subsequently, travel-delayed by a length of the fourth segment, moving an exit side of the fourth segment away from the billet, wherein all segments are moved away from the billet until a preset final thickness is adjusted.

13. The method according to claim 12, wherein the adjusting speed is <2.5 mm/min.

14. The method according to claim 12, wherein, for a constant casting speed and with the solidification point of the billet having passed the first and second segments, the exit side of the first segment and the entry side of the second segment in the casting direction are moved in a first one of the adjusting steps away from the billet by moving the first and second segments at a joint connecting the first and second segments away from the billet controlled in accordance with a set-point, and after the first and second segments have reached a target position, an exit side of the second segment and an entry side of the third segment in the casting direction are moved in a second one of the adjusting steps away from the billet by moving the second and third segments at a joint connecting the second and third segments away from the billet, and after the second and third segments have reached a target position, the third and further segments are moved away from the billet sequentially in the same manner in further ones of the adjusting steps until all segments have reached a target position.

15. The method according to claim 14, wherein the segments are adjusted at a constant adjusting speed with dynamic position control without surpassing a predetermined force threshold value, the method further comprising the step of determining an adjusting speed of the segments for moving the segments away based on permissible billet elongation limits and a current casting speed in combination with a current format adjustment of the section or based on a required volume flow of the billet.

16. The method according to claim 15, wherein the adjusting speed is calculated, based on the current casting speed, the segment length, and the format thickness change, by the equation $$V=Ds/Ls*Vcast$$

wherein Ds is the format thickness change, Ls is the segment length, and Vcast is the current casting speed.

17. The method according to claim 16, wherein the adjusting steps are carried out by hydraulic adjusting devices, further comprising the step-of monitoring the adjusting steps via current cylinder pressures of the hydraulic adjusting devices, wherein, when a predetermined force threshold value is surpassed, force control is applied instead of position control and wherein, when the target position has been reached, the position control is applied again.

18. The method according to claim 17, wherein the adjusting steps are hydraulically controlled and wherein the adjusting steps begin at an exit side of the first segment in the casting direction and are successively continued at. the entry side and the exit side of the successively arranged segments, and wherein the adjusting speed of two successively arranged segments is inevitably synchronous.

* * * * *